US012259154B2

(12) United States Patent
Ishigami et al.

(10) Patent No.: US 12,259,154 B2
(45) Date of Patent: Mar. 25, 2025

(54) INDOOR UNIT OF AIR-CONDITIONING APPARATUS

(71) Applicant: Mitsubishi Electric Corporation, Tokyo (JP)

(72) Inventors: Katsuya Ishigami, Tokyo (JP); Tetsuya Tazawa, Tokyo (JP); Takeshi Kawamura, Tokyo (JP); Naoya Matsunaga, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 489 days.

(21) Appl. No.: 17/628,662

(22) PCT Filed: Oct. 17, 2019

(86) PCT No.: PCT/JP2019/040792
§ 371 (c)(1),
(2) Date: Jan. 20, 2022

(87) PCT Pub. No.: WO2021/075010
PCT Pub. Date: Apr. 22, 2021

(65) Prior Publication Data

US 2022/0252299 A1 Aug. 11, 2022

(51) Int. Cl.
*F24F 13/20* (2006.01)

(52) U.S. Cl.
CPC ..... *F24F 13/20* (2013.01); *F24F 2013/207* (2013.01)

(58) Field of Classification Search
CPC ..... F24F 13/20; F24F 11/89; F24F 2013/207; H02G 3/06
See application file for complete search history.

(56) References Cited

U.S. PATENT DOCUMENTS 4,153,310 A * 5/1979 Loving ..... F24F 1/56 174/559
4,977,750 A * 12/1990 Metcalfe ..... F24F 1/027 62/298

(Continued)

FOREIGN PATENT DOCUMENTS

EP 3527902 A1 * 8/2019 ..... F24F 1/0314
JP S62-021582 U 2/1987

(Continued)

OTHER PUBLICATIONS

Office Action dated Dec. 13, 2022 issued in corresponding JP Patent Application No. 2021-552048 (and Machine Translation).

(Continued)

*Primary Examiner* — Joel M Attey
*Assistant Examiner* — For K Ling
(74) *Attorney, Agent, or Firm* — Posz Law Group, PLC

(57) ABSTRACT

A conduit attachment component with a box shape in an indoor unit of an air-conditioning apparatus includes a first component, a second component, and a third component. The second component and the third component are removably attached to the first component. The second component includes a first plate portion to which a conduit is connected. The third component includes a second plate portion. Any one of a plurality of side portions of the conduit attachment component is a first side portion, and a side portion of the plurality of side portions, adjacent to the first side portion, is a second side portion. In a first state, the first plate portion is the first side portion, and the second plate portion is the second side portion. In a second state, the first plate portion is the second side portion, and the second plate portion is the first side portion.

8 Claims, 7 Drawing Sheets

(56) References Cited

U.S. PATENT DOCUMENTS

| | | | | |
|---|---|---|---|---|
| 5,043,532 | A * | 8/1991 | Hatano | F24F 1/022 174/559 |
| 6,318,105 | B1 * | 11/2001 | Bushnell | F24F 1/027 62/262 |
| 6,378,320 | B1 * | 4/2002 | Matambo | F24F 1/22 361/807 |
| 6,892,551 | B2 * | 5/2005 | Gunji | F24F 1/0057 62/262 |
| 2003/0042010 | A1 * | 3/2003 | Kobayashi | F24F 13/20 165/122 |
| 2018/0224153 | A1 * | 8/2018 | Latham | F24F 3/0442 |
| 2020/0208868 | A1 * | 7/2020 | Jayarathne | F24F 13/20 |

FOREIGN PATENT DOCUMENTS

| | | | | |
|---|---|---|---|---|
| JP | 2003-074904 | A | 3/2003 | |
| JP | 2006-046830 | A | 2/2006 | |
| JP | 2006-064298 | A | 3/2006 | |
| JP | 2017-096577 | A | 6/2017 | |
| KR | 20070119301 | A * | 12/2007 | F24F 1/02 |

OTHER PUBLICATIONS

International Search Report dated Nov. 19, 2019, issued in corresponding International Patent Application No. PCT/JP2019/040792 (and English Machine Translation).

* cited by examiner

INDOOR UNIT OF AIR-CONDITIONING APPARATUS

CROSS REFERENCE TO RELATED APPLICATION

This application is a U.S. National Stage Application of International Application No. PCT/JP2019/040792, filed on Oct. 17, 2019, the contents of which are incorporated herein by reference.

TECHNICAL FIELD

The present disclosure relates to an indoor unit of an air-conditioning apparatus, in which cables to be connected are housed in a conduit.

BACKGROUND ART

An indoor unit of an air-conditioning apparatus includes an electrical component box having electrical components housed therein such as a control board. Cables such as a communication cable and a power supply cable are electrically connected to the electrical component box. Depending on the country or region of use, the safety measures may require cables located outside an indoor unit to be housed in a conduit. The conduit is a pipe made of metal, resin, or other material, in which cables are housed. A related-art indoor unit, in which cables to be connected are housed in a conduit, includes a conduit attachment component to which the conduit is connected.

Since a conduit is hard and difficult to bend, the conduit needs to be located with a relatively large radius of curvature. Therefore, if a conduit can be connected to a conduit attachment component only from one direction, depending on the installation environment of an indoor unit, the conduit may not be able to be connected to the conduit attachment component.

In view of that, a related-art indoor unit of an air-conditioning apparatus includes a conduit attachment component to which a conduit is connectable from multiple directions (see Patent Literature 1). Specifically, the conduit attachment component in the indoor unit described in Patent Literature 1 has a box shape. On a plurality of faces of this conduit attachment component, through holes are formed for cables to be inserted. Each of the through holes is closed by a removal piece that is removable at the installation site of the indoor unit. When the indoor unit described in Patent Literature 1 is installed, first the removable piece, which covers an intended through hole for inserting a cable, is removed. Then, a portion of the cable protruding from the conduit is inserted into the intended through hole. The conduit is connected to the conduit attachment component by using a fixing part attached to the circumferential edge of the intended through hole.

CITATION LIST

Patent Literature

Patent Literature 1: Japanese Patent Unexamined Publication No. 2006-64298

SUMMARY OF INVENTION

Technical Problem

There is a case where it is desired to change the direction in which a conduit is connected to a conduit attachment component, for example, when the installation location of an indoor unit has been changed. In such a case, in the indoor unit described in Patent Literature 1, a removable piece, covering an intended through hole for additionally inserting a cable, is removed. Then, the cable is inserted into the intended through hole. The conduit is connected to the conduit attachment component by using a fixing part attached to the circumferential edge of the intended through hole. Thus, in the indoor unit described in Patent Literature 1, when the direction in which the conduit is connected to the conduit attachment component is attempted to be changed, the through hole, into which the cable has been previously inserted, remains uncovered.

In the country or region where cables are required to be housed in a conduit, there may be a requirement to protect user's hands or fingers from contact with the cables electrically connected to the electrical component box. In this case, when there is a through hole that remains uncovered on the conduit attachment component as described above, a user can possibly insert his/her finger from this uncovered through hole, and then the finger may contact the cables located in the conduit attachment component, Thus, the indoor unit described in Patent Literature 1 has a problem that the direction in which the conduit is connected to the conduit attachment component cannot be changed in some cases.

The present disclosure has been achieved to solve the above problems; and an objective of the present disclosure is to provide an indoor unit of an air-conditioning apparatus that makes it possible to change the direction in which a conduit is connected to a conduit attachment component even under conditions that prevent the indoor unit described in Patent Literature 1 from changing the direction in which a conduit is connected to a conduit attachment component.

Solution to Problem

An indoor unit of an air-conditioning apparatus according to an embodiment of the present disclosure includes; a main body portion including an electrical component box to which a cable is electrically connected; and a conduit attachment component to which a conduit is connected, the conduit attachment component having a box shape and being attached to the main body portion, the conduit having the cable housed therein, wherein the conduit attachment component includes a first component, a second component, and a third component, the first component is attached to the main body portion, the second component includes a first plate portion, the first plate portion includes a first opening port into which the cable is inserted, the first plate portion being configured to be connected to the conduit, the third component includes a second plate portion; the second component is configured to be removably attached to the first component in a first state or a second state, in the first state, the first plate portion makes up a first side portion, the first side portion being one of a plurality of side portions of the conduit attachment component, in the second state, the first plate portion makes up a second side portion, the second side portion being a side portion of the plurality of side portions of the conduit attachment component, the side portion being adjacent to the first side portion, and the third component is configured to be removably attached to the first component with the second plate portion making up the second side portion in the first state, and the third component is configured to be removably attached to the first component with the second plate portion making up the first side portion in the second state.

Advantageous Effects of Invention

In the indoor unit of an air-conditioning apparatus according to an embodiment of the present disclosure, when the conduit attachment component is in the first state, the first plate portion to which the conduit is connected makes up the first side portion. In the indoor unit of an air-conditioning apparatus according to an embodiment of the present disclosure, when the conduit attachment component is in the second state, the first plate portion to which the conduit is connected makes up the second side portion. At this time, in the indoor unit of an air-conditioning apparatus according to an embodiment of the present disclosure, a side portion of the conduit attachment component, which is opened by moving the first plate portion, is covered with the second plate portion. Due to this configuration, the indoor unit of an air-conditioning apparatus according to an embodiment of the present disclosure makes it possible to change the direction in which the conduit is connected to the conduit attachment component even under conditions that prevent the indoor unit described in Patent Literature 1 from changing the direction in which a conduit is connected to a conduit attachment component.

DESCRIPTION OF EMBODIMENT

In an embodiment below, an example of an indoor unit of an air-conditioning apparatus according to the present disclosure is described with reference to the diagrams. Note that the indoor unit of an air-conditioning apparatus described in the embodiment below is illustrated merely as an example. The indoor unit of an air-conditioning apparatus according to the present disclosure is not limited to the configuration described in the embodiment below. In the embodiment below, a wall-mounted indoor unit is described as an example of the indoor unit of an air-conditioning apparatus according to the present disclosure. In the embodiment below, an example of the configuration of the indoor unit of an air-conditioning apparatus according to the present disclosure is described while the indoor unit mounted on the wall of a room is observed. In the embodiment below, the forward/rearward direction, the upward/downward direction, and the rightward/leftward direction, which are used in describing an example of the configuration of the indoor unit of an air-conditioning apparatus according to the present disclosure, are defined as directions when the indoor unit mounted on the wall is observed from the front.

Embodiment

Figure 1:
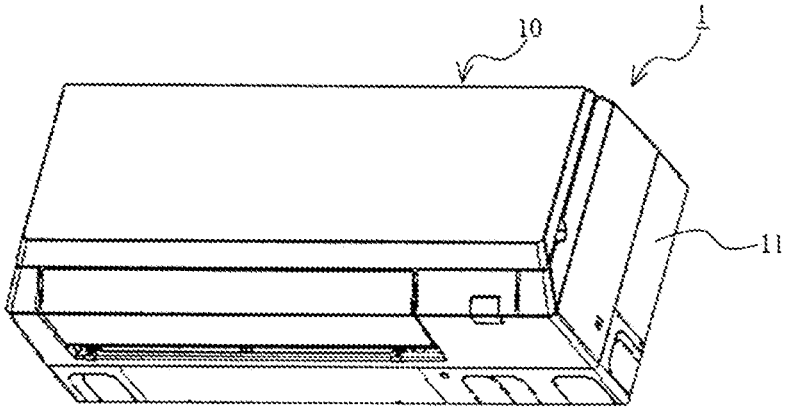
FIG. 1 is a perspective view of an indoor unit of an air-conditioning apparatus according to a present embodiment when the indoor unit is viewed from the position in front of, and on the right lower side of, the indoor unit.
Figure 2:
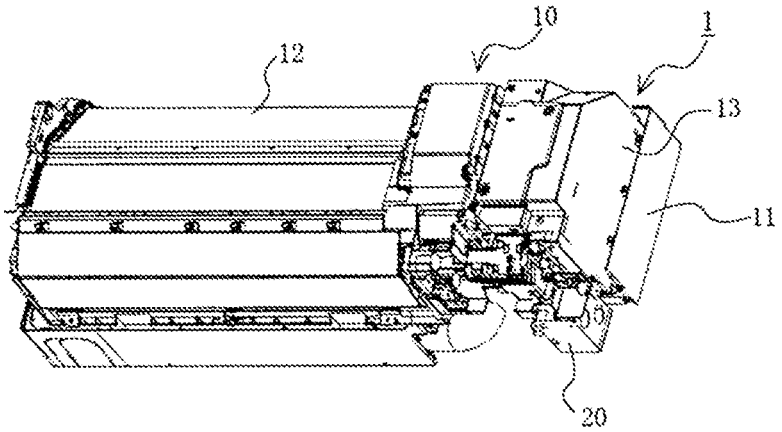
FIG. 2 is a perspective view illustrating the inside of the indoor unit of an air-conditioning apparatus according to the present embodiment when the indoor unit is viewed from the position in front of, and on the right lower side of, the indoor unit.
Figure 3:
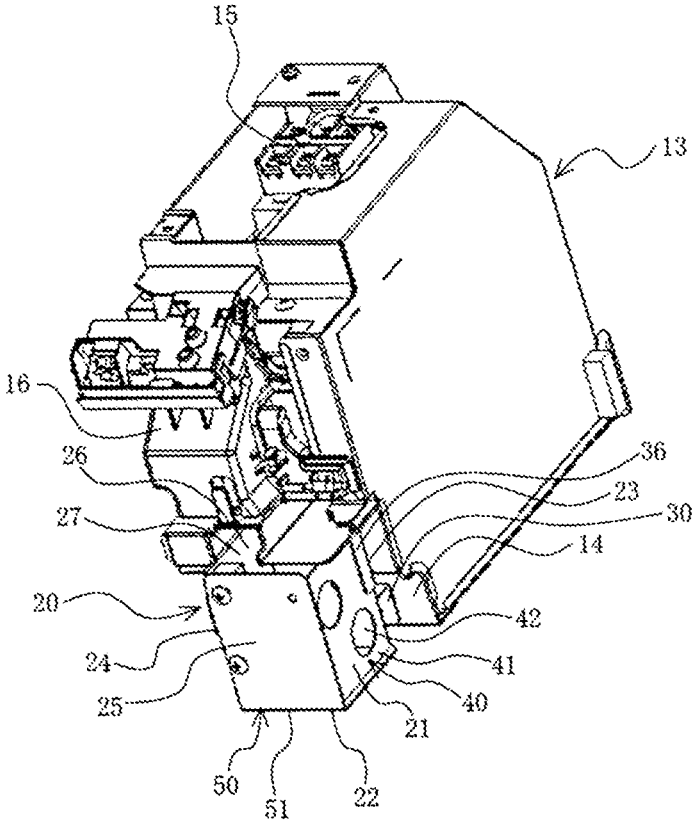
FIG. 3 is a perspective view illustrating an electrical component box and a conduit attachment component in the indoor unit of an air-conditioning apparatus according to the present embodiment.
Figure 4:
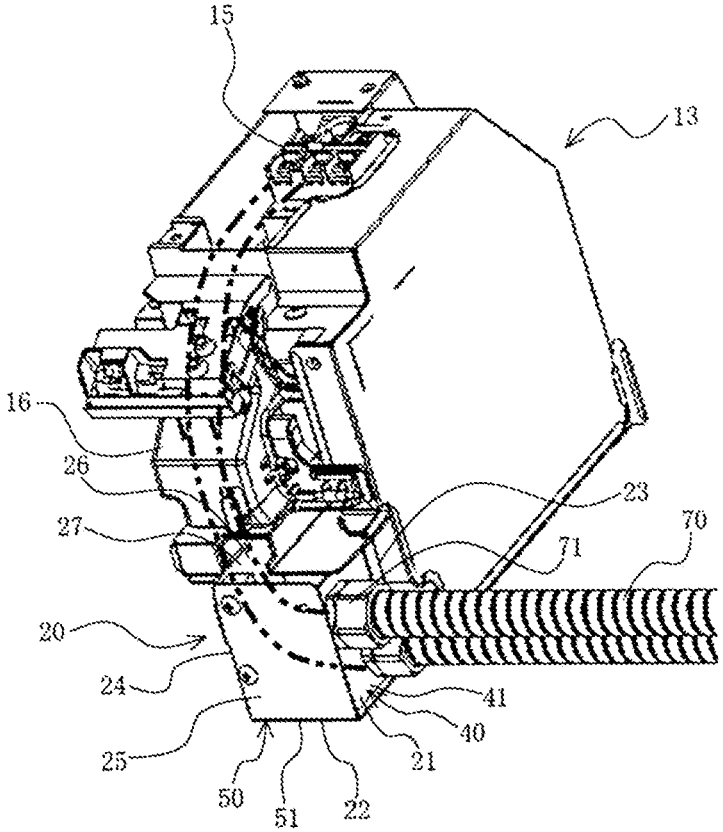
FIG. 4 is a perspective view illustrating the electrical component box and the conduit attachment component in the indoor unit of an air-conditioning apparatus according to the present embodiment.
Figure 5:
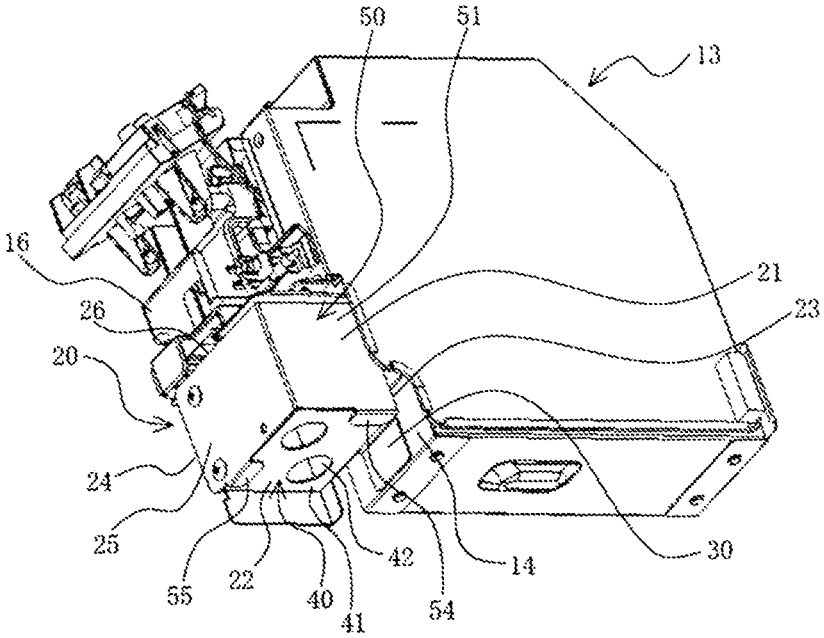
FIG. 5 is a perspective view illustrating the electrical component box and the conduit attachment component in the indoor unit of an air-conditioning apparatus according to the present embodiment.

FIG. 1 is a perspective view of an indoor unit of an air-conditioning apparatus according to a present embodiment when the indoor unit is viewed from the position in front of, and on the right lower side of, the indoor unit. FIG. 2 is a perspective view illustrating the inside of the indoor unit of an air-conditioning apparatus according to the present embodiment when the indoor unit is viewed from the position in front of, and on the right lower side of, the indoor unit. FIGS. 3 to 5 are perspective views illustrating an electrical component box and a conduit attachment component in the indoor unit of an air-conditioning apparatus according to the present embodiment. Specifically, FIGS. 3 and 4 illustrate an electrical component box 13 and a conduit attachment component 20 when they are viewed from the right lower side of an indoor unit 1. FIG. 5 illustrates the electrical component box 13 and the conduit attachment component 20 when they are viewed from the position at the rear of, and on the right lower side of, the indoor unit 1. FIGS. 3 and 5 illustrate the conduit attachment component 20 before conduits 70 are connected thereto. FIG. 4 illustrates the conduit attachment component 20 with the conduits 70 connected thereto. Note that the conduit attachment component 20 of the indoor unit 1 according to the present embodiment is either in a first state or a second state. FIGS. 3 and 4 illustrate the conduit attachment component 20 in the first state. FIG. 5 illustrates the conduit attachment component 20 in the second state.

The indoor unit 1 includes a main body portion 10. The main body portion 10 includes a housing 11, a heat exchanger 12, and the electrical component box 13. The housing 11 forms the outer shell portion of the indoor unit 1. In the housing 11, an airflow passage is formed. In this airflow passage, the heat exchanger 12 is provided. That is, air having flowed into the airflow passage in the housing 11 exchanges heat with refrigerant flowing through the heat exchanger 12, and thereafter is blown to the outside of the housing 11.

The electrical component box 13 is housed in the housing 11. Specifically, the electrical component box 13 is located at the right-side end portion of the housing 11. Cables such as a communication cable and a power supply cable are electrically connected to the electrical component box 13. More specifically, the electrical component box 13 has electrical components housed therein, such as a control board. The electrical component box 13 includes a terminal block 15 on, for example, the front side portion. The terminal block 15 is electrically connected to the electrical components in the electrical component box 13. The cables such as a communication cable and a power supply cable are electrically connected to the terminal block 15. Through this connection, the electrical components in the electrical component box 13 and the cables are electrically connected. Note that in the present embodiment, a cover 16 is provided on a bottom portion 14 of the electrical component box 13. In the present embodiment, as illustrated by chain double-dashed lines that are phantom lines in FIG. 4, the cables are routed around the inside of the conduit attachment component 20 and the inside of the cover 16, and are then electrically connected to the terminal block 15. The conduit attachment component 20 will be described later.

An air-conditioning apparatus including the indoor unit 1 is of a configuration in which cables located outside the indoor unit 1 are housed in the conduits 70. Due to this configuration, the indoor unit 1 includes the conduit attachment component 20 with a box shape. The conduit attachment component 20 is attached to the bottom portion 14 of the electrical component box 13. The conduits 70 having the cables housed therein are connected to the conduit attachment component 20. Note that the conduit attachment component 20 may be attached to any location in the main body portion 10 other than to the electrical component box 13.

In the present embodiment, the conduit attachment component 20 has an approximately cuboid shape. That is, the conduit attachment component 20 has six faces. Taking into account the orientation of the indoor unit 1 when it is installed, the orientation of the indoor unit 1 when it is transported, the orientation of the indoor unit 1 when it is assembled, and other factors, each of these six faces can be a side portion. That is, the conduit attachment component 20 can be regarded as having six side portions. Hereinafter; these six faces are referred to as a "first side portion 21," a "second side portion 22," a "third side portion 23," a "fourth side portion 24," a "fifth side portion 25," and an "open side portion 26."

The first side portion 21 is one of a plurality of side portions of the conduit attachment component 20. In the present embodiment, the rightward side portion of the conduit attachment component 20 is defined as the first side portion 21. The second side portion 22 is one of the plurality of side portions of the conduit attachment component 20, and is adjacent to the first side portion 21. In the present embodiment, the back side portion of the conduit attachment component 20 is defined as the second side portion 22. The third side portion 23 is one of the plurality of side portions of the conduit attachment component 20. In the present embodiment, the top side portion of the conduit attachment component 20 is defined as the third side portion 23.

The fourth side portion 24 is one of the plurality of side portions of the conduit attachment component 20, and is opposite to the first side portion 21. In the present embodiment, the leftward side portion of the conduit attachment component 20 is defined as the fourth side portion 24. The fifth side portion 25 is one of the plurality of side portions of the conduit attachment component 20, and is opposite to the third side portion 23. In the present embodiment, the bottom side portion of the conduit attachment component 20 is defined as the fifth side portion 25. The open side portion 26 is one of the plurality of side portions of the conduit attachment component 20. In the present embodiment, the front side portion of the conduit attachment component 20 is defined as the open side portion 26.

The conduit attachment component 20 includes a first component 30, a second component 40, and a third component 50. The first component 30 is attached to the main body portion 10. In the present embodiment, the first component 30 is attached to the bottom portion 14 of the electrical component box 13.

The second component 40 is removably attached to the first component 30. In the present embodiment, the second component 40 is attached to the first component 30 by screwing in a manner to be described later. The second component 40 includes a first plate portion 41 that makes up one of the plurality of side portions of the conduit attachment component 20. The first plate portion 41 is, for example, a plate with an approximately rectangular shape. The first plate portion 41 includes first opening ports 42. Cables are inserted into the first opening ports 42 to be electrically connected to the electrical component box 13. Note that in the present embodiment, two first opening ports 42 are formed on the first plate portion 41, but any number of first opening ports 42 may be formed. In addition, the conduits 70 having the cables housed therein are connected to the first plate portion 41. Note that the conduits 70 are not limited to being connected to the first plate portion 41 in a particular configuration, but various publicly-known configurations may be used to connect the conduits 70 to the first plate portion 41. In the present embodiment, the conduits 70 are connected to the first plate portion 41 by using publicly-known fixing parts 71 attached to the circumferential edge of each of the first opening ports 42.

In other words, a portion of the cable, protruding from the conduit 70, is inserted into the first opening port 42 and routed around the inside of the conduit attachment component 20. Note that the open side portion 26 of the conduit attachment component 20 includes a second opening port 27 through which a cable passes when the cable is routed around the inside of the conduit attachment component 20 to the electrical component box 13. Due to this structure, a portion of the cable protruding from the conduit 70 passes through the first opening port 42, the inside of the conduit attachment component 20, the second opening port 27, and the inside of the cover 16, and then is electrically connected to the electrical component box 13.

The third component 50 is removably attached to the first component 30, In the present embodiment, the third component 50 is attached to the first component 30 by screwing in a manner to be described later. The third component 50 includes a second plate portion 51 that makes up one of the plurality of side portions of the conduit attachment component 20. The second plate portion 51 is, for example, a plate with an approximately rectangular shape.

The second component 40 and the third component 50 can be removably attached to the first component 30 in two different states. Specifically, the second component 40 and the third component 50 can be removably attached to the first component 30 in each of the first state illustrated in FIG. 3 and other diagram, and the second state illustrated in FIG. 5. More specifically, in the first state as illustrated in FIGS.

3 and 4, the first plate portion 41 of the second component 40 makes up the first side portion 21 of the conduit attachment component 20. In the second state as illustrated in FIG. 5, the first plate portion 41 of the second component 40 makes up the second side portion 22 of the conduit attachment component 20. In the first state as illustrated in FIGS. 3 and 4, the second plate portion 51 of the third component makes up the second side portion 22 of the conduit attachment component 20. In the second state as illustrated in FIG. 5, the second plate portion 51 of the third component makes up the first side portion 21 of the conduit attachment component 20.

In other words, when the second component 40 has been attached to the first component 30 in the first state, while the third component 50 has not yet been attached to the first component 30, then, in this state, the second side portion 22 is opened, although in the second state, the first plate portion 41 of the second component 40 makes up the second side portion 22. However, when the third component 50 is attached to the first component 30 in the first state, the second side portion 22 having been open can be covered with the second plate portion 51 of the third component. Likewise, when the second component 40 has been attached to the first component 30 in the second state, while the third component 50 has not yet been attached to the first component 30, then, in this state, the first side portion 21 is opened, although in the first state, the first plate portion 41 of the second component 40 makes up the first side portion 21. However, when the third component 50 is attached to the first component 30 in the second state, the first side portion 21 having been open can be covered with the second plate portion 51 of the third component.

As described above, in the indoor unit 1 according to the present embodiment, a side portion of the conduit attachment component 20, which is opened by moving the first plate portion 41 to which the conduits 70 are connected, can be covered with the second plate portion 51. Due to this configuration, the indoor unit according to the present embodiment makes it possible to change the direction in which the conduits 70 are connected to the conduit attachment component 20 even under conditions that prevent the indoor unit described in Patent Literature 1 from changing the direction in which a conduit is connected to a conduit attachment component.

Note that the first component 30 is not limited to being attached to the main body portion 10 in a particular configuration, but it is preferable for the first component 30 to be attached to the main body portion 10 by sport welding or other methods in such a manner as to prevent the first component 30 from being detached from the main body portion 10. The reason for this is that at the time of changing the direction in which the conduits 70 are connected to the conduit attachment component 20, there is no need to detach the first component 30 from the main body portion 10. Thus, the first component 30 is attached to the main body portion 10 in such a manner as to prevent the first component 30 from being detached from the main body portion 10, so that a component, to be detached from the main body portion 10 at the time of changing the direction in which the conduits 70 are connected to the conduit attachment component 20, is clearly identified. This facilitates the work for changing the direction in which the conduits 70 are connected to the conduit attachment component 20.

The conduit attachment component 20 as described above can be implemented by, for example, having the following configuration. Hereinafter, an example of the detailed configuration of the conduit attachment component 20 is described.

Figure 6:
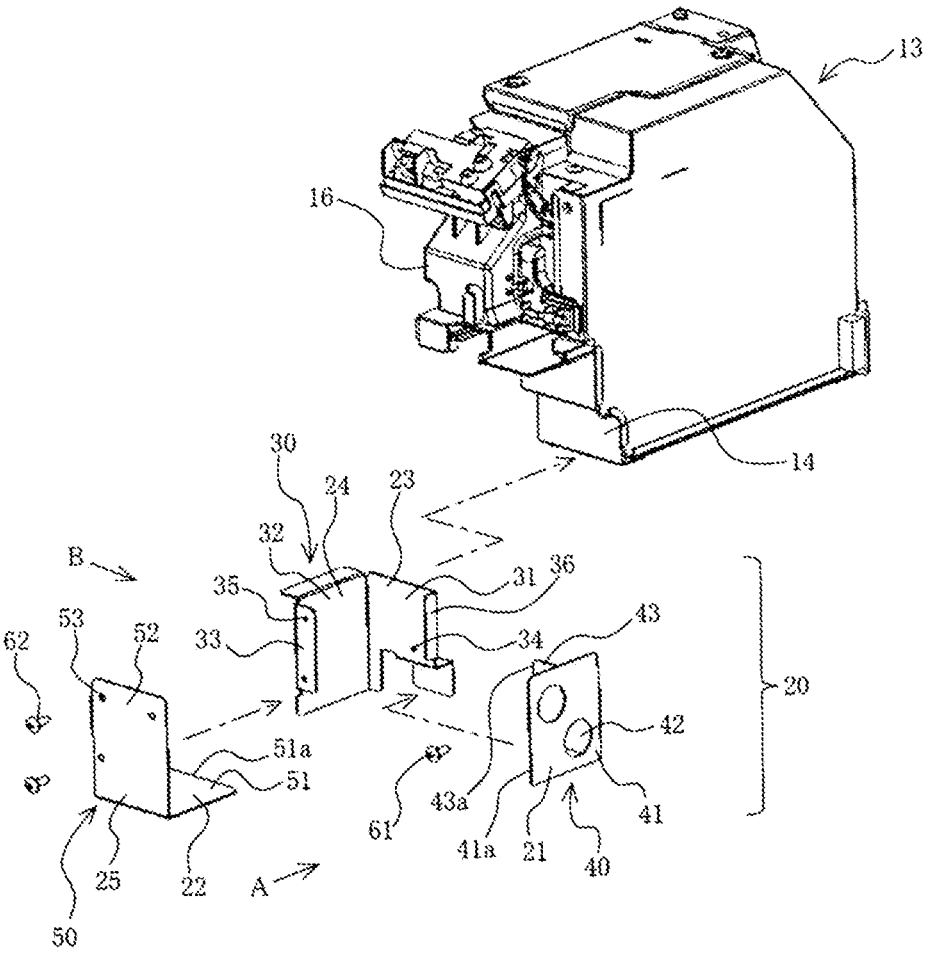
FIG. 6 is an exploded perspective view illustrating the conduit attachment component in the indoor unit of an air-conditioning apparatus according to the present embodiment.
Figure 7:
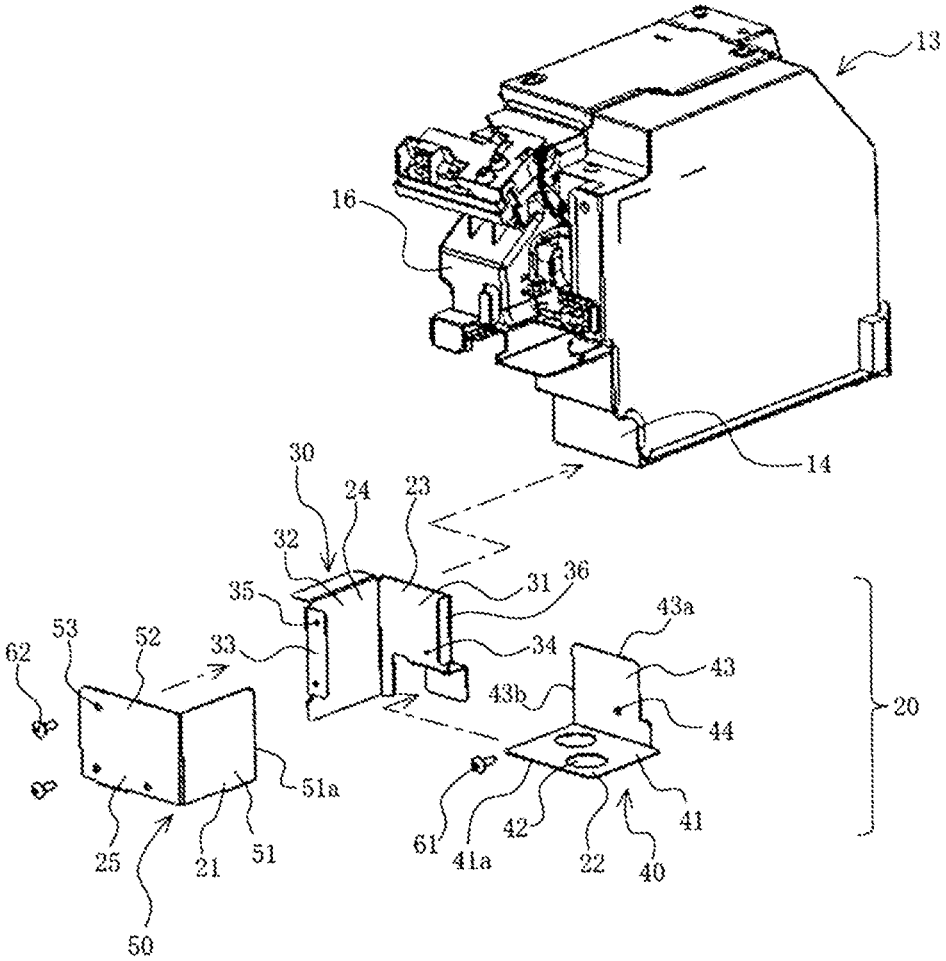
FIG. 7 is an exploded perspective view illustrating the conduit attachment component in the indoor unit of an air-conditioning apparatus according to the present embodiment.
Figure 8:
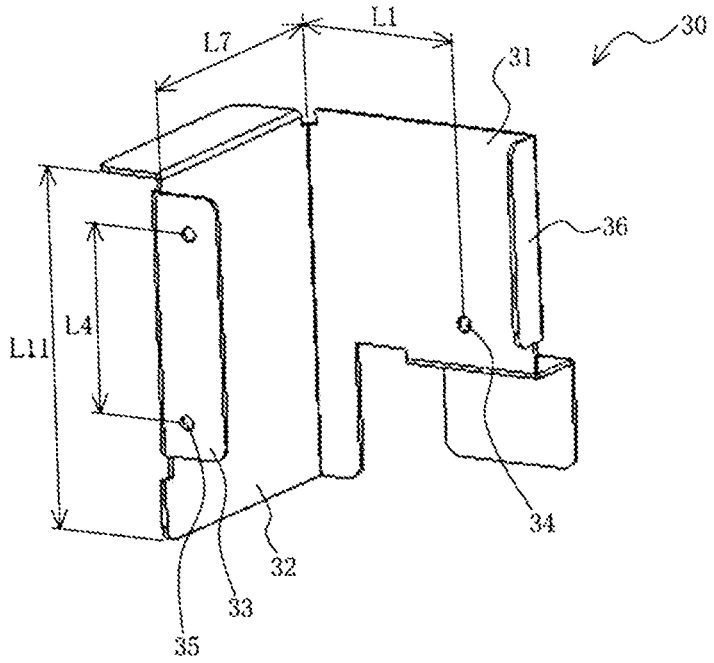
FIG. 8 is a perspective view illustrating a first component of the conduit attachment component in the indoor unit of an air-conditioning apparatus according to the present embodiment.
Figure 9:
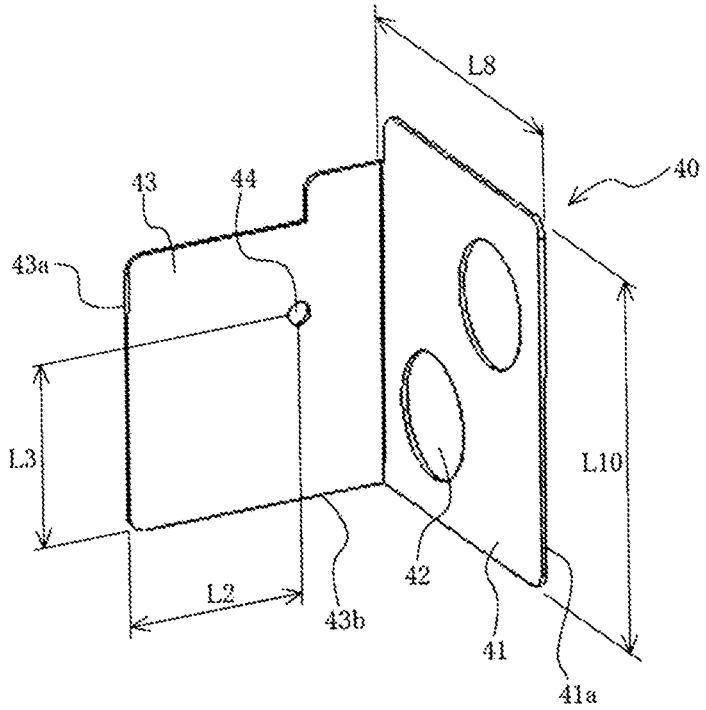
FIG. 9 is a perspective view illustrating a second component of the conduit attachment component in the indoor unit of an air-conditioning apparatus according to the present embodiment.
Figure 10:
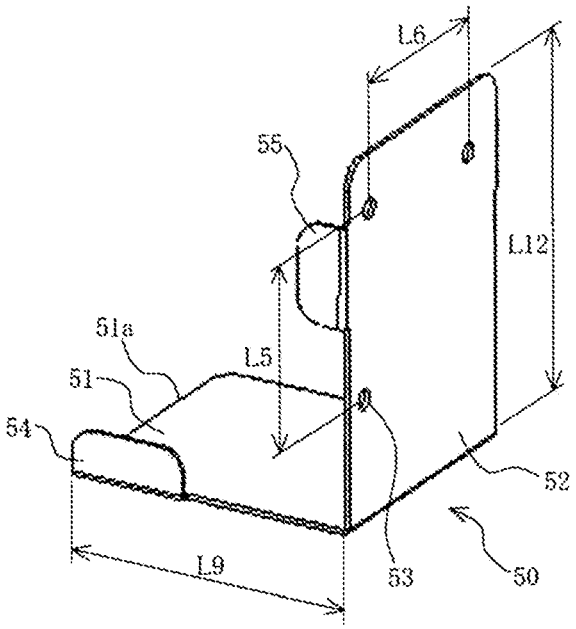
FIG. 10 is a perspective view illustrating a third component of the conduit attachment component in the indoor unit of an air-conditioning apparatus according to the present embodiment.

FIGS. 6 and 7 are exploded perspective views illustrating the conduit attachment component in the indoor unit of an air-conditioning apparatus according to the present embodiment. FIG. 8 is a perspective view illustrating a first component of the conduit attachment component in the indoor unit of an air-conditioning apparatus according to the present embodiment. FIG. 9 is a perspective view illustrating a second component of the conduit attachment component in the indoor unit of an air-conditioning apparatus according to the present embodiment. FIG. 10 is a perspective view illustrating a third component of the conduit attachment component in the indoor unit of an air-conditioning apparatus according to the present embodiment, Note that FIG. 6 illustrates an exploded perspective view of the conduit attachment component 20 in the first state. FIG. 7 illustrates an exploded perspective view of the conduit attachment component 20 in the second state. FIGS. 6 and 7 also illustrate the electrical component box 13 to which the conduit attachment component 20 is attached. FIGS. 6 and 7 illustrate the electrical component box 13 and the conduit attachment component 20 when they are viewed from the right lower side of the indoor unit 1. FIG. 8 is a perspective view of the first component 30 illustrated in FIG. 6 when it is viewed from the direction of an arrow A. FIG. 9 is a perspective view of the second component 40 illustrated in FIG. 6 when it is viewed from the direction of an arrow B. FIG. 10 is a perspective view of the third component 50 illustrated in FIG. 6 when it is viewed from the direction of the arrow B.

The first component 30 includes a third plate portion 31, a fourth plate portion 32, and a fifth plate portion 33. The third plate portion 31 is, for example, a plate with an approximately rectangular shape. The third plate portion 31 makes up the third side portion 23 of the conduit attachment component 20. In the manner as described above, the first component 30 is attached to the electrical component box 13. In the present embodiment, a rearward part of the third plate portion 31 is attached to the electrical component box 13. As illustrated in FIGS. 6 and 7, the bottom portion 14 of the electrical component box 13 has a step-like shape at its rearward part. The rearward part of the third plate portion 31 is attached to a section recessed into the top of this step-like portion, Thus, the third plate portion 31 is formed with its rearward part protruding upward.

In the present embodiment, the second component 40 is removably attached to the third plate portion 31, As described above, in the present embodiment, the second component 40 is attached to the first component 30 by screwing. Due to this screwing, the third plate portion 31 includes a first female screw portion 34. Note that in the present embodiment, a single first female screw portion 34 is formed on the third plate portion 31, but any number of first female screw portions 34 may be formed.

The fourth plate portion 32 is, for example, a plate with an approximately rectangular shape. The fourth plate portion 32 makes up the fourth side portion 24 of the conduit attachment component 20. The fourth plate portion 32 protrudes downward from the third plate portion 31 at approximately a right angle relative to the third plate portion 31.

The fifth plate portion 33 is, for example, a plate with an approximately rectangular shape. The fifth plate portion 33 protrudes sideward from the fourth plate portion 32 at approximately a right angle relative to the fourth plate portion 32, and is opposite to the third plate portion 31. In the present embodiment, the third component 50 is removably attached to the fifth plate portion 33. As described above, in the present embodiment, the third component 50 is attached to the first component 30 by screwing. Due to this screwing, the fifth plate portion 33 includes second female screw portions 35. Note that in the present embodiment, two second female screw portions 35 are formed on the fifth plate portion 33, but any number of second female screw portions 35 may be formed.

The second component 40 includes the first plate portion 41 described above, and a sixth plate portion 43. The sixth plate portion 43 is, for example, a plate with an approximately rectangular shape. The sixth plate portion 43 along with the third plate portion 31 of the first component 30 makes up the third side portion 23 of the conduit attachment component 20. The sixth plate portion 43 protrudes from the first plate portion 41 at approximately a right angle relative to the first plate portion 41. In the present embodiment, the sixth plate portion 43 is removably attached to the third plate portion 31 of the first component 30. Thus, the sixth plate portion 43 includes a first screw insertion hole 44. When the sixth plate portion 43 is removably attached to the third plate portion 31 of the first component 30, the upper face of the sixth plate portion 43 is oriented to face the lower face of the third plate portion 31 of the first component 30. Then, a first screw 61 inserted through the first screw insertion hole 44 on the sixth plate portion 43 is screwed into the first female screw portion 34 on the third plate portion 31 of the first component 30. With this screwing, the sixth plate portion 43 can be removably attached to the third plate portion 31 of the first component 30.

The second component 40 is attached to the first component 30 in either the first state illustrated in FIG. 6 or the second state illustrated in FIG. 7. On the sixth plate portion 43 according to the present embodiment, the first screw insertion hole 44 is formed at a position where the first screw insertion hole 44 faces the first female screw portion 34 in the first state, and at a position where the first screw insertion hole 44 faces the first female screw portion 34 in the second state. With this configuration, the first female screw portion 34 can be used in common between the case where the second component 40 is attached to the first component 30 in the first state, and the case where the second component 40 is attached to the first component 30 in the second state. Due to this configuration, production costs of the first component 30 can be reduced, and thus production costs of the indoor unit 1 can be reduced, compared to the case where separate first female screw portions 34 are used for the case where the second component 40 is attached to the first component 30 in the first state, and for the case where the second component 40 is attached to the first component 30 in the second state.

In the present embodiment, the first screw insertion hole 44 is used in common between the case where the second component 40 is attached to the first component 30 in the first state, and the case where the second component 40 is attached to the first component 30 in the second state.

Specifically, in a case where the second component 40 is attached to the first component 30 in the first state, the second component 40 is oriented such that the sixth plate portion 43 protrudes leftward from the upper end portion of the first plate portion 41, and then the second component 40 is attached to the first component 30. At this time, an end portion 43*a* of the sixth plate portion 43 of the second component 40 is brought into contact with the fourth plate portion 32 of the first component 30 to attach the second component 40 to the first component 30. This can prevent the second component 40 from rotating at the time of screw-fixing even though the second component 40 is screwed at a single location with the first screw 61, so that the second component 40 can be attached to the first component 30. That is, only a single first screw insertion hole 44 is needed for the second component 40 to be attached to the first component 30 in the first state.

In a case where the second component 40 is attached to the first component 30 in the second state, the second component 40 is oriented such that the sixth plate portion 43 protrudes forward from the upper end portion of the first plate portion 41, and then the second component 40 is attached to the first component 30. At this time, an end portion 43*b* of the sixth plate portion 43 of the second component 40 is brought into contact with the fourth plate portion 32 of the first component 30 to attach the second component 40 to the first component 30. This can prevent the second component 40 from rotating at the time of screw-fixing even though the second component 40 is screwed at a single location with the first screw 61, so that the second component 40 can be attached to the first component 30. That is, only a single first screw insertion hole 44 is needed for the second component 40 to be attached to the first component 30 in the second state.

In the present embodiment, a distance L1, a distance L2, and a distance L3 are equal. The distance L1 is from the fourth plate portion 32 to the first female screw portion 34. The distance L2 is from the end portion 43*a* to the first screw insertion hole 44. The distance L3 is from the end portion 43*b* to the first screw insertion hole 44. That is, the relationship between L1, L2, and L3 is expressed by the following expression (1).

$$L1 = L2 = L3 \tag{1}$$

The relationship between L1, L2, and L3 is expressed by the expression (1), so that the first screw insertion hole 44 can be used in common between the case where the second component 40 is attached to the first component 30 in the first state, and the case where the second component 40 is attached to the first component 30 in the second state, Thus, the relationship between L1, L2, and L3 is expressed by the expression (1), so that production costs of the second component 40 can be reduced, and thus production costs of the indoor unit 1 can be reduced, compared to the case where separate first screw insertion holes 44 are used for the case where the second component 40 is attached to the first component 30 in the first state, and for the case where the second component 40 is attached to the first component 30 in the second state.

The third component 50 includes the second plate portion 51 described above, and a seventh plate portion 52. The seventh plate portion 52 is, for example, a plate with an approximately rectangular shape. The seventh plate portion 52 protrudes from the second plate portion 51 at approximately a right angle relative to the second plate portion 51. The seventh plate portion 52 makes up the fifth side portion 25 of the conduit attachment component 20, In the present embodiment, the seventh plate portion 52 is removably attached to the fifth plate portion 33 of the first component 30. Thus, the seventh plate portion 52 includes second screw insertion holes 53. When the seventh plate portion 52 is removably attached to the fifth plate portion 33 of the first component 30, the upper face of the seventh plate portion 52 is oriented to face the lower face of the fifth plate portion 33 of the first component 30. Then, second screws 62 inserted through the second screw insertion holes 53 on the seventh plate portion 52 are screwed into the second female screw portions 35 on the fifth plate portion 33 of the first component 30. With this screwing, the seventh plate portion 52 can be removably attached to the fifth plate portion 33 of the first component 30.

The third component 50 is attached to the first component 30 in either the first state illustrated in FIG. 6 or the second state illustrated in FIG. 7. On the seventh plate portion 52 according to the present embodiment, the second screw insertion holes 53 are formed at a position where the second screw insertion holes 53 face the second female screw portions 35 in the first state, and at a position where the second screw insertion holes 53 face the second female screw portions 35 in the second state. Thus, a distance L4, a distance L5, and a distance L6 are equal. The distance L4 extends between two second female screw portions 35. The distance L5 extends between two second screw insertion holes 53 through which the second screws 62 are inserted in the first state. The distance L6 extends between two second screw insertion holes 53 through which the second screws 62 are inserted in the second state. That is, the relationship between L4, L5, and L6 is expressed by the following expression (2).

$$L4 = L5 = L6 \tag{2}$$

With this configuration, the second female screw portions 35 can be used in common between the case where the third component 50 is attached to the first component 30 in the first state, and the case where the third component 50 is attached to the first component 30 in the second state. Due to this configuration, production costs of the third component 50 can be reduced, and thus production costs of the indoor unit 1 can be reduced, compared to the case where separate second female screw portions 35 are used for the case where the third component 50 is attached to the first component 30 in the first state, and for the case where the third component 50 is attached to the first component 30 in the second state.

In the present embodiment, when the second component 40 is attached to the first component 30, the first screw 61 is inserted through the first screw insertion hole 44 in a direction that is the same as the direction in which the second screws 62 are inserted through the second screw insertion holes 53 when the third component 50 is attached to the first component 30. Specifically, in the present embodiment, when the second component 40 is attached to the first component 30, the first screw 61 is inserted through the first screw insertion hole 44 on the sixth plate portion 43 of the second component 40 from below the sixth plate portion 43. Then, the first screw 61 is screwed upward into the first female screw portion 34 on the third plate portion 31 of the first component 30. In addition, when the third component 50 is attached to the first component 30, the second screws 62 are inserted through the second screw insertion holes 53 on the seventh plate portion 52 of the third component 50 from below the seventh plate portion 52. Then, the second screws 62 are screwed upward into the second female screw portions 35 on the fifth plate portion 33 of the first component 30. The first screw 61 is inserted through the first screw insertion hole 44 in a direction that is the same as the direction in which the second screws 62 are inserted through the second screw insertion holes 53, so that attachment/detachment of the second component 40 and the third component 50 is facilitated. This makes it easy to change the direction in which the conduits 70 are connected to the conduit attachment component 20.

The conduit attachment component 20 according to the present embodiment is of a configuration in which in both the first state and the second state, a gap is not formed between the first component 30 and the second component 40, between the first component 30 and the third component 50, or between the second component 40 and the third component 50. Such a configuration as described above can be implemented by forming the first component 30, the second component 40, and the third component 50 in such a manner as to satisfy, for example, the following expressions (3) and (4).

$$L7 = L8 = L9 \tag{3}$$

$$L10 = L11 = L12 \tag{4}$$

L7 represents a distance between the third plate portion 31 and the fifth plate portion 33. The first plate portion 41 includes opposite end portions in a direction in which the third plate portion 31 and the fifth plate portion 33 are opposite to each other. One of the opposite end portions, which is closer to the fifth plate portion 33 than the other, is represented as an end portion 41*a*, In this case, L8 represents a distance between the end portion 41*a* and a face of the sixth plate portion 43 facing the third plate portion 31. The second plate portion 51 includes opposite end portions in a direction in which the third plate portion 31 and the fifth plate portion 33 are opposite to each other. One of the opposite end portions, which is closer to the third plate portion 31 than the other, is represented as an end portion 51*a*. In this case, L9 represents a distance between the end portion 51*a* and a face of the seventh plate portion 52 facing the fifth plate portion 33. L10 represents one of the dimensions of the first plate portion 41, which extends in a direction normal to the second side portion 22 when the first plate portion 41 makes up the first side portion 21. In other words, in the present embodiment, L10 represents the dimension of the first plate portion 41 in the forward/rearward direction when the first plate portion 41 makes up the first side portion 21. L11 represents one of the dimensions of the fourth plate portion 32, which extends in a direction parallel to L10. L12 represents a length of the seventh plate portion 52 protruding from the second plate portion 51 in the direction of L10 when the second plate portion 51 makes up the second side portion 22. In other words, in the present embodiment, L12 represents the length of the seventh plate portion 52 protruding forward from the second plate portion 51 when the second plate portion 51 makes up the second side portion 22.

In the configuration of the conduit attachment component 20, a gap is not formed between the first component 30 and the second component 40, between the first component 30 and the third component 50, or between the second component 40 and the third component 50. This configuration can reliably protect user's hands or fingers from contact with the cables in the conduit attachment component 20 from between the first component 30 and the second component 40, between the first component 30 and the third component 50, and between the second component 40 and the third component 50. Due to this configuration in which a gap is not formed between the first component 30 and the second component 40, between the first component 30 and the third component 50, or between the second component 40 and the third component 50, the indoor unit 1 can improve its safety.

In the present embodiment, at least one of the first component 30 and the third component 50 includes a support portion that faces the first plate portion 41 of the second component 40 from outside with the second component 40 and the third component 50 being attached to the first component 30. Specifically, as illustrated in FIG. 3, a support portion 36 faces the first plate portion 41 from outside in the first state. As illustrated in FIGS. 6 and 8, the support portion 36 is included in the first component 30. Note that the third component 50 may include the support portion 36. As illustrated in FIG. 5, a support portion 54 and a support portion 55 face the first plate portion 41 from outside in the second state. The support portion 54 and the support portion 55 are included in the third component 50. Note that the first component 30 may include at least one of the support portion 54 and the support portion 55. As long as at least one of the support portion 54 and the support portion 55 is provided, effects of the support portion can be obtained. The effects will be described later.

When the conduits 70 are connected to the first plate portion 41 of the second component 40, or when the indoor unit 1 is installed with the conduits 70 connected to the first plate portion 41, the conduits 70 may be pulled. In this case, the first plate portion 41 is applied with a load that causes the first plate portion 41 to be deformed outward. However, the support portion that faces the first plate portion 41 of the second component 40 from outside is provided, so that the first plate portion 41 that is likely to be deformed outward can be supported by the support portion, and deformation of the first plate portion 41 can be minimized.

The indoor unit 1 of an air-conditioning apparatus according to the present embodiment includes: the main body portion 10 including the electrical component box 13 to which a cable is electrically connected; and the conduit attachment component 20 to which the conduit 70 is connected, the conduit attachment component 20 having a box shape and being attached to the main body portion 10, the conduit 70 having the cable housed therein. The conduit attachment component 20 includes the first component 30, the second component 40, and the third component 50. The first component 30 is attached to the main body portion 10. The second component 40 includes the first plate portion 41. The first plate portion 41 includes the first opening port 42 into which the cable is inserted, and the conduit 70 is connected to the first plate portion 41. The third component 50 includes the second plate portion 51. The second component 40 is removably attached to the first component 30 in the first state or the second state. In the first state, the first plate portion 41 makes up the first side portion 21, the first side portion 21 being one of a plurality of side portions of the conduit attachment component 20. In the second state, the first plate portion 41 makes up the second side portion 22, the second side portion 22 being a side portion of the plurality of side portions of the conduit attachment component 20, the side portion being adjacent to the first side portion 21. The third component 50 is removably attached to the first component 30 with the second plate portion 51 making up the second side portion 22 in the first state, and the third component 50 is removably attached to the first component 30 with the second plate portion 51 making up the first side portion 21 in the second state.

In the indoor unit 1 according to the present embodiment, a side portion of the conduit attachment component 20, which is opened by moving the first plate portion 41 to which the conduits 70 are connected, can be covered with the second plate portion 51. Due to this configuration, the indoor unit according to the present embodiment makes it possible to change the direction in which the conduits 70 are connected to the conduit attachment component 20 even under conditions that prevent the indoor unit described in Patent Literature 1 from changing the direction in which a conduit is connected to a conduit attachment component.

Note that in the present embodiment, the conduit attachment component 20 is attached to the main body portion in such an orientation that the first side portion 21 serves as the rightward side portion, while the second side portion 22 serves as the back side portion. However, the orientation of the conduit attachment component 20 when it is attached to the main body portion 10 is merely an example. For another example, the conduit attachment component 20 may be attached to the main body portion in such an orientation that the first side portion 21 serves as the leftward side portion, while the second side portion 22 serves as the bottom side portion.

REFERENCE SIGNS LIST

1: indoor unit, 10: main body portion, 11: housing, 12: heat exchanger, 13: electrical component box, 14: bottom portion, 15: terminal block, 16: cover, 20: conduit attachment component, 21: first side portion, 22: second side portion, 23: third side portion, 24: fourth side portion, 25: fifth side portion, 26: open side portion, 27: second opening port, 30: first component, 31: third plate portion, 32: fourth plate portion, 33: fifth plate portion, 34: first female screw portion, 35: second female screw portion, 36: support portion, 40: second component, 41: first plate portion, 41*a*: end portion, 42: first opening port, 43: sixth plate portion, 43*a*: end portion, 43*b*: end portion, 44: first screw insertion hole, 50: third component, 51: second plate portion, 51*a*: end portion, 52: seventh plate portion, 53: second screw insertion hole, 54: support portion, 55: support portion, 61: first screw, 62: second screw, 70: conduit, 71: fixing part

The invention claimed is:

1. An indoor unit of an air-conditioning apparatus, the indoor unit comprising:

a main body portion including an electrical component box to which a cable is electrically connected; and a conduit attachment component to which a conduit is connected, the conduit attachment component having a box shape having a plurality of side portions each corresponding to a different respective face of the box shape including at least a first side portion and a second side portion adjacent to the first side portion, the conduit attachment being attached to the main body portion, the conduit having the cable housed therein, wherein the conduit attachment component includes a first component, a second component, and a third component, the first component is attached to the main body portion, the second component includes a first plate portion, the first plate portion includes a first opening port into which the cable is inserted, the first plate portion being configured to be connected to the conduit, the third component includes a second plate portion, the second component is configured to be removably attached to the first component in a first state in which the first opening port is on one face of the box shape and in a second state in which the first opening port is on an other face of the box shape, in the first state, the first plate portion makes up the first side portion and the second plate portion makes up the second side portion, in the second state, the first plate portion makes up the second side portion and the second plate portion makes up the first side portion, and the third component is configured to be removably attached to the first component with the second plate portion making up the second side portion in the first state, and the third component is configured to be removably attached to the first component with the second plate portion making up the first side portion in the second state.

2. The indoor unit of an air-conditioning apparatus of claim 1, wherein the plurality of side portions of the conduit attachment component corresponding to different respective faces of the box shape further include a third side portion, a fourth side portion opposite to the first side portion, and a fifth side portion opposite to the third side portion, the first component includes a third plate portion to which the second component is removably attached, the third plate portion making up the third side portion, a fourth plate portion protruding from the third plate portion, and making up the fourth side portion, and a fifth plate portion to which the third component is removably attached, the fifth plate portion protruding from the fourth plate portion and being opposite to the third plate portion, the second component includes a sixth plate portion protruding from the first plate portion, the sixth plate portion being removably attached to the third plate portion of the first component, and the third component includes a seventh plate portion protruding from the second plate portion, the seventh plate portion making up the fifth side portion, and being removably attached to the fifth plate portion of the first component.

3. The indoor unit of an air-conditioning apparatus of claim 1, wherein in the conduit attachment component, in both the first state and the second state, a gap is not formed between the first component and the second component, between the first component and the third component, or between the second component and the third component.

4. The indoor unit of an air-conditioning apparatus of claim 1, wherein the first component includes a first female screw portion, the second component includes a first screw insertion hole, the second component is configured to be removably attached to the first component with a first screw inserted through the first screw insertion hole and screwed into the first female screw portion, and the second component includes the first screw insertion hole at a position where the first screw insertion hole faces the first female screw portion in the first state, and at a position where the first screw insertion hole faces the first female screw portion in the second state.

5. The indoor unit of an air-conditioning apparatus of claim 4, wherein the first component includes a second female screw portion, the third component includes a second screw insertion hole, the third component is configured to be removably attached to the first component with a second screw inserted through the second screw insertion hole and screwed into the second female screw portion, the third component includes the second screw insertion hole at a position where the second screw insertion hole faces the second female screw portion in the first state, and at a position where the second screw insertion hole faces the second female screw portion in the second state, and when the second component is attached to the first component, the first screw is inserted through the first screw insertion hole in a direction that is same as a direction in which the second screw is inserted through the second screw insertion hole when the third component is attached to the first component.

6. The indoor unit of an air-conditioning apparatus of claim 1, wherein the first component includes a second female screw portion, the third component includes a second screw insertion hole, the third component is configured to be removably attached to the first component with a second screw inserted through the second screw insertion hole and screwed into the second female screw portion, and the third component includes the second screw insertion hole at a position where the second screw insertion hole faces the second female screw portion in the first state, and at a position where the second screw insertion hole faces the second female screw portion in the second state.

7. The indoor unit of an air-conditioning apparatus of claim 1, wherein at least one of the first component and the third component includes a support portion, the support portion facing the first plate portion of the second component from outside with the second component and the third component both attached to the first component.

8. The indoor unit of an air-conditioning apparatus of claim 1, wherein the first component is attached to the electrical component box.

* * * * *